US008438667B2

(12) United States Patent
Grogro et al.

(10) Patent No.: US 8,438,667 B2
(45) Date of Patent: May 14, 2013

(54) APPAREL INCORPORATING A PROTECTIVE ELEMENT

(75) Inventors: Daniela Grogro, Portland, OR (US); David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 747 days.

(21) Appl. No.: 12/566,025

(22) Filed: Sep. 24, 2009

(65) Prior Publication Data

US 2011/0067160 A1 Mar. 24, 2011

(51) Int. Cl.
*A41D 1/06* (2006.01)

(52) U.S. Cl.
USPC ..... 2/228

(58) Field of Classification Search ..... 2/23, 114, 2/94, 102, 228, 238, 79, 227, 105, 267, 181, 2/310
See application file for complete search history.

(56) References Cited

U.S. PATENT DOCUMENTS

| | | | | |
|---|---|---|---|---|
| 2,016,664 | A * | 10/1935 | Brewster | 2/112 |
| 2,939,462 | A | 6/1960 | McClung | |
| 3,106,717 | A * | 10/1963 | Cuvin | 2/70 |
| 3,119,904 | A | 1/1964 | Anson | |
| 3,916,900 | A * | 11/1975 | Breyer et al. | 604/365 |
| 4,455,686 | A | 6/1984 | Zide | |
| 4,549,317 | A * | 10/1985 | D'Ambrosio | 2/237 |
| 4,982,447 | A | 1/1991 | Henson | |
| 5,423,087 | A | 6/1995 | Krent | |
| 5,689,836 | A | 11/1997 | Fee | |
| 5,940,888 | A | 8/1999 | Sher | |
| 6,654,960 | B2 | 12/2003 | Cho | |
| 6,743,325 | B1 | 6/2004 | Taylor | |
| 7,114,189 | B1 | 10/2006 | Kleinert | |
| 7,216,370 | B1 * | 5/2007 | Warner et al. | 2/23 |
| 7,234,171 | B2 * | 6/2007 | Rowe et al. | 2/114 |
| 7,993,322 | B2 * | 8/2011 | Brud et al. | 604/396 |
| 2007/0000005 | A1 | 1/2007 | Wang | |
| 2007/0101474 | A1 | 5/2007 | Skottheim et al. | |
| 2008/0264557 | A1 | 10/2008 | Kim | |
| 2008/0290556 | A1 | 11/2008 | Kim | |
| 2009/0070911 | A1 | 3/2009 | Chang | |
| 2010/0129573 | A1 | 5/2010 | Kim | |
| 2010/0193117 | A1 | 8/2010 | Kim | |
| 2010/0205716 | A1 | 8/2010 | Kim | |
| 2010/0205722 | A1 | 8/2010 | Kim | |
| 2010/0206472 | A1 | 8/2010 | Kim | |

FOREIGN PATENT DOCUMENTS

| | | |
|---|---|---|
| CA | 2517311 | 2/2007 |
| GB | 2457478 | 8/2009 |

OTHER PUBLICATIONS

International Search Report and Written Opinion, mailed Mar. 15, 2011 for PCT Application No. PCT/US2010/049589.

* cited by examiner

*Primary Examiner* — Tejash Patel
(74) *Attorney, Agent, or Firm* — Plumsea Law Group, LLC

(57) ABSTRACT

An article of apparel may include may include a garment portion and at least one protective element. The garment portion and the protective element have a configuration that forms a gap, separation, or pleat structure through, for example, folding or overlapping of a textile element of the garment portion. The gap, separation, or pleat structure may permit the protective element to move independent of other portions of the apparel at the joint, thereby enhancing a range of movement of the individual and the overall comfort of the apparel.

28 Claims, 17 Drawing Sheets

APPAREL INCORPORATING A PROTECTIVE ELEMENT

BACKGROUND

Protective elements or materials that impart padding, cushioning, or otherwise attenuate impact forces are commonly incorporated into a variety of products. Athletic apparel, for example, often incorporates protective elements that shield the wearer from contact with other athletes, equipment, or the ground. More specifically, pads used in American football and hockey incorporate protective elements that provide impact protection to various parts of a wearer. Helmets utilized during American football, hockey, bicycling, skiing, snowboarding, and skateboarding incorporate protective elements that impart cushioning to the head during falls or crashes. Similarly, gloves utilized in soccer (e.g., by goalies) and hockey incorporate protective elements that provide protection to the hands of a wearer.

SUMMARY

An article of apparel is disclosed below that includes a garment portion and at least one protective element. The garment portion and the protective element have a configuration that forms a gap, separation, or pleat structure. As an example, the gap, separation, or pleat structure may permit the protective element to move independent of other portions of the apparel at the joint, thereby enhancing a range of movement of the individual and the overall comfort of the apparel.

In one configuration, the garment portion is formed from a plurality of joined textile elements and has a first fold and a second fold that form a pleat structure, the first fold being located outward from the second fold. The protective element is at least partially located within the first fold and absent from an area within the second fold.

In another configuration, the garment portion is formed from at least a first textile element and a second textile element. The first textile element forms a first fold and a second fold that form a pleat structure, with the first fold being located outward from the second fold. The protective element is located within the first fold and has a first surface and an opposite second surface. The first surface is located outward from the second surface. Additionally, the first textile element is joined to the first surface and the second surface, and the second textile element is joined to the second surface.

In yet another configuration, the apparel includes a band for extending around a portion of a wearer, at least one textile element, and a protective element. The band is formed from a stretchable material and the textile element is joined to the band, with a portion of the textile element extending away from the band. The protective element is formed from a compressible material. A gap extends between the protective element and the portion of the textile element extending away from the band.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various articles of apparel that incorporate protective elements. As discussed in greater detail below, the protective elements (e.g., foam pads, a plurality of foam elements) may bunch or otherwise compress to restrict movement of an individual wearing the apparel, particularly in the area of a joint (e.g., hip, knee, shoulder, elbow). A gap, separation, or pleat structure, for example, permits the protective element to move independent of other portions of the apparel at the joint, thereby enhancing a range of movement of the individual and the overall comfort of the apparel.

Apparel Configuration

Figure 1:
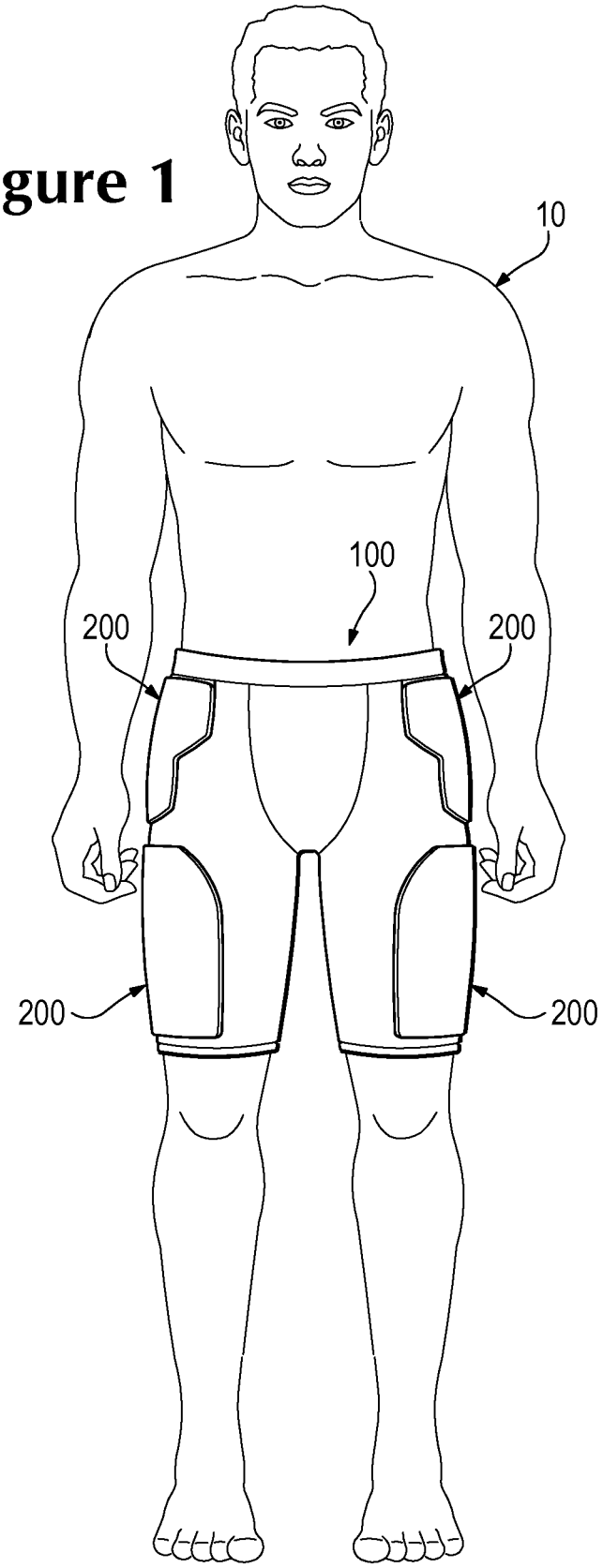
FIG. 1 is a front elevational view of an individual wearing an article of apparel.
Figure 2:
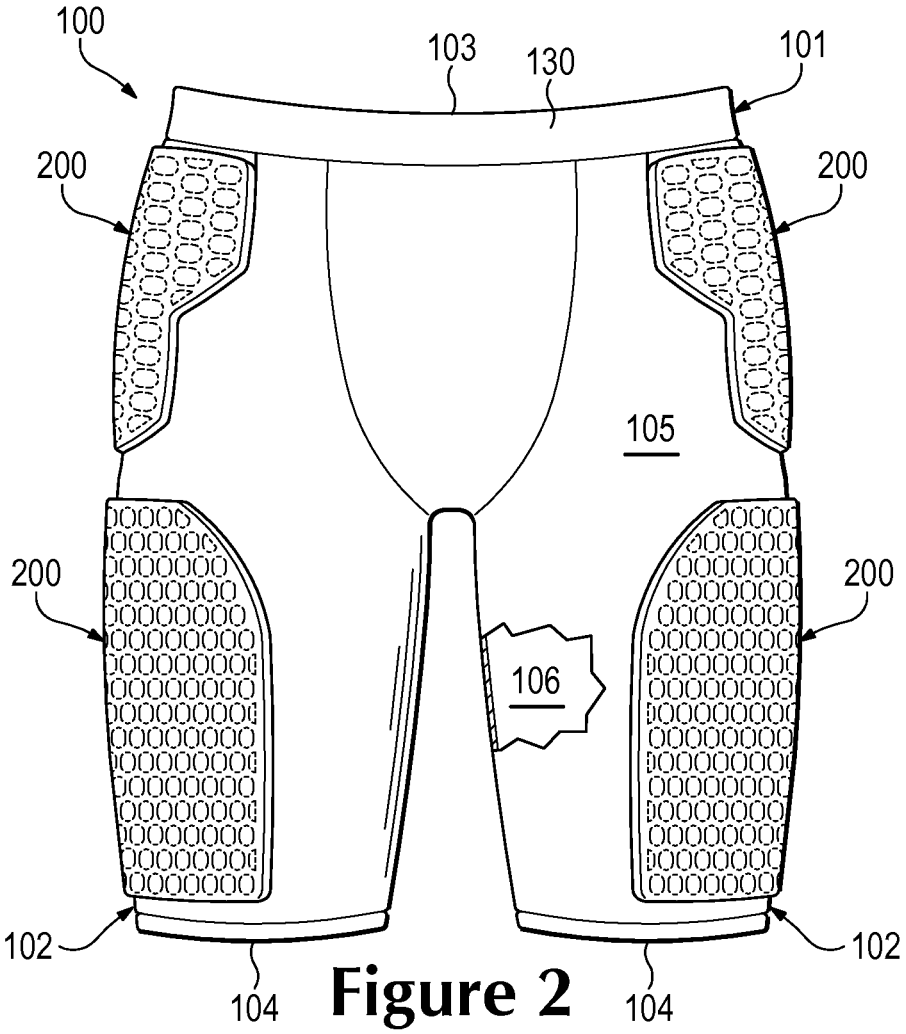
FIG. 2 is a front elevational view of the article of apparel.
Figure 3:
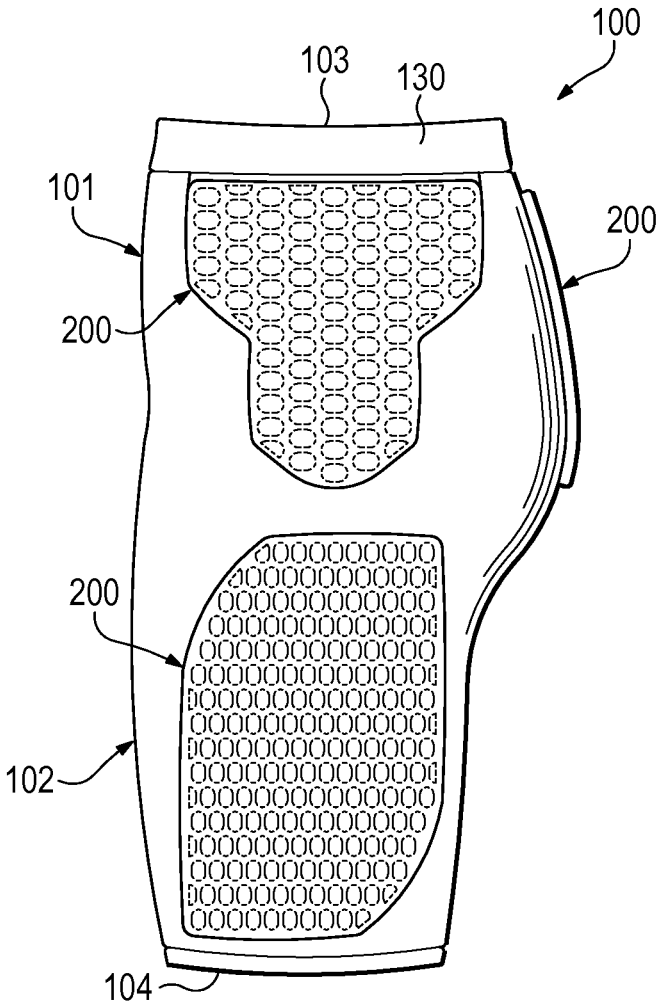
FIGS. 3 and 4 are side elevational views of the article of apparel.
Figure 4:
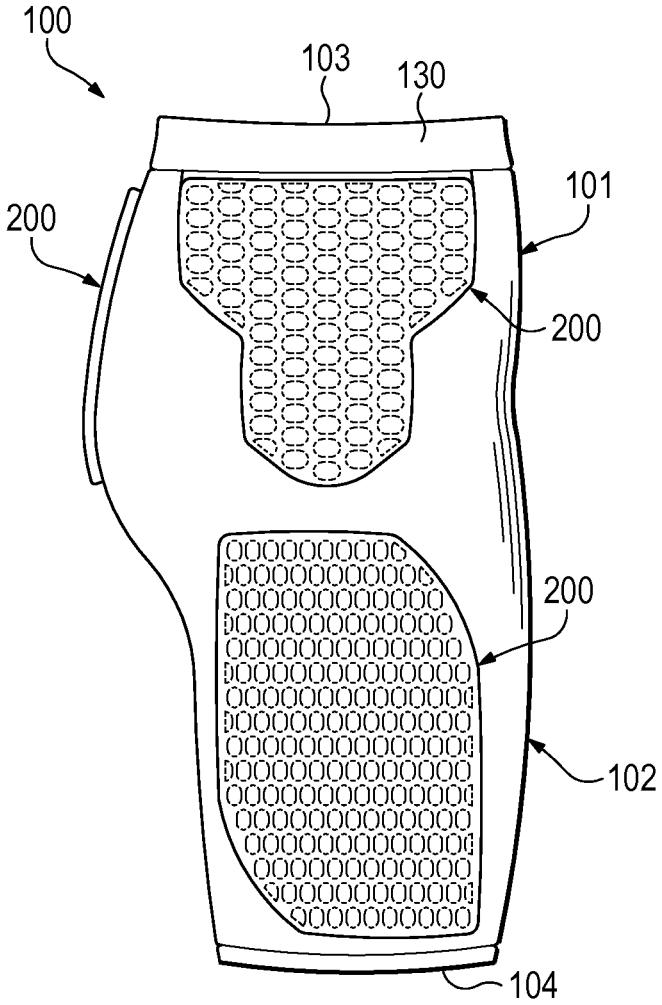
Figure 5:
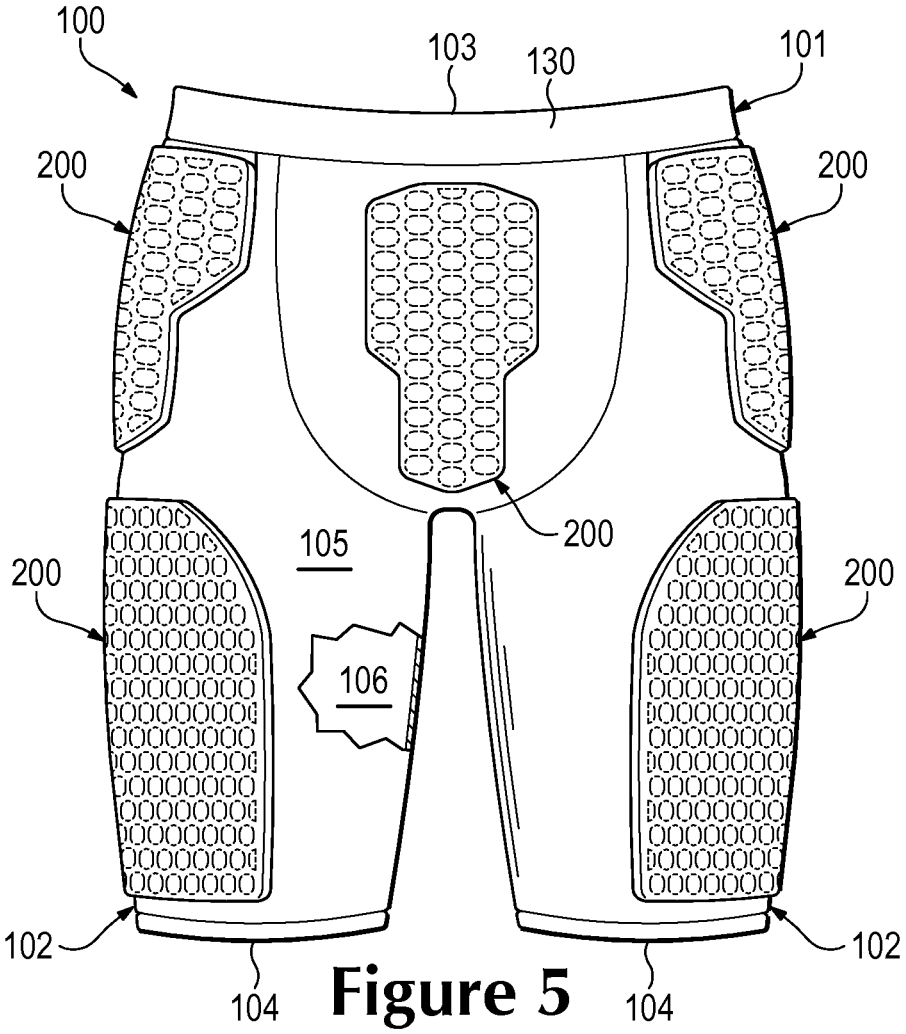
FIG. 5 is a rear elevational view of the article of apparel.
Figure 6:
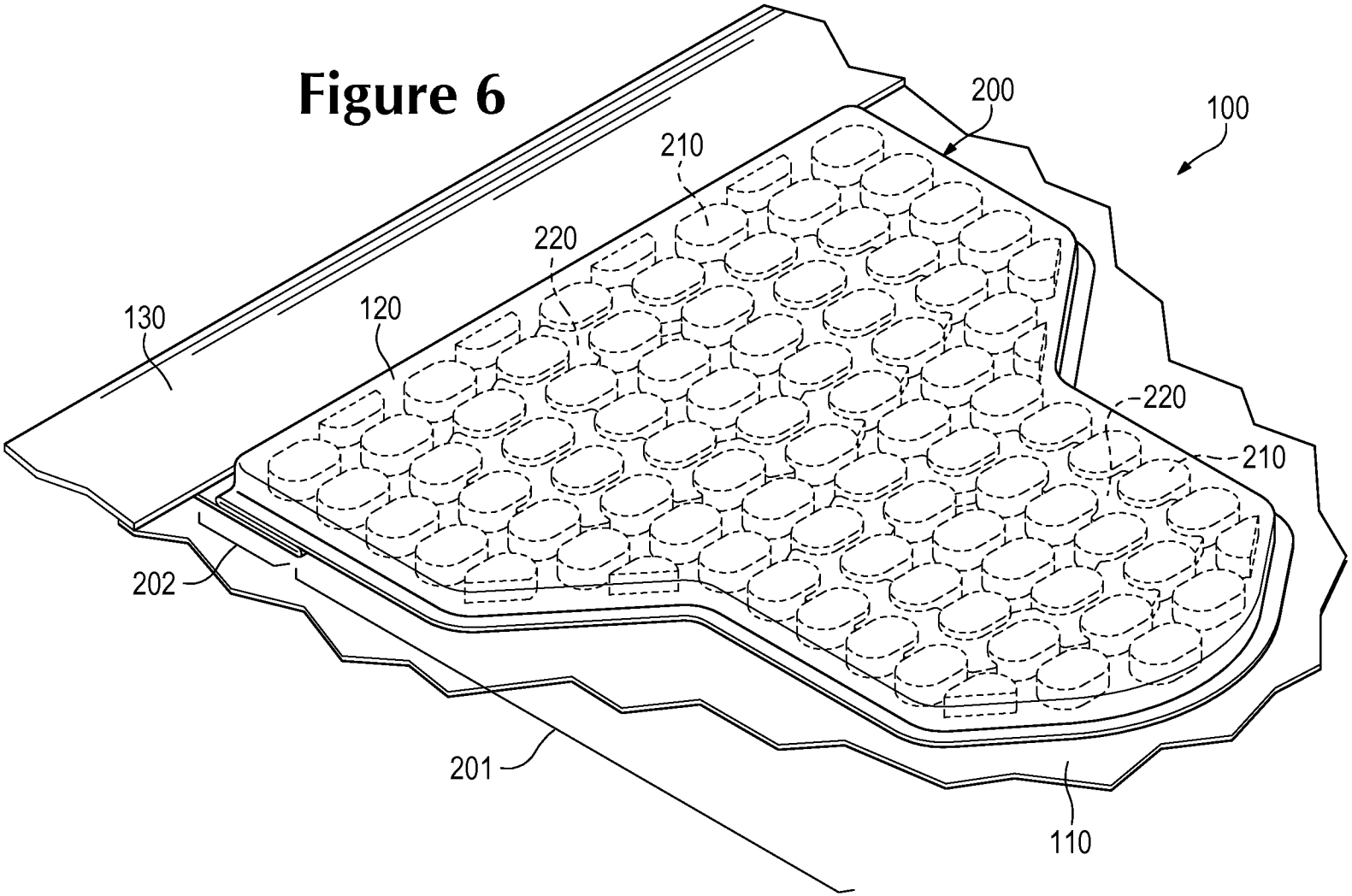
FIG. 6 is a perspective view of a portion of the article of apparel that includes a protective element.
Figure 7:
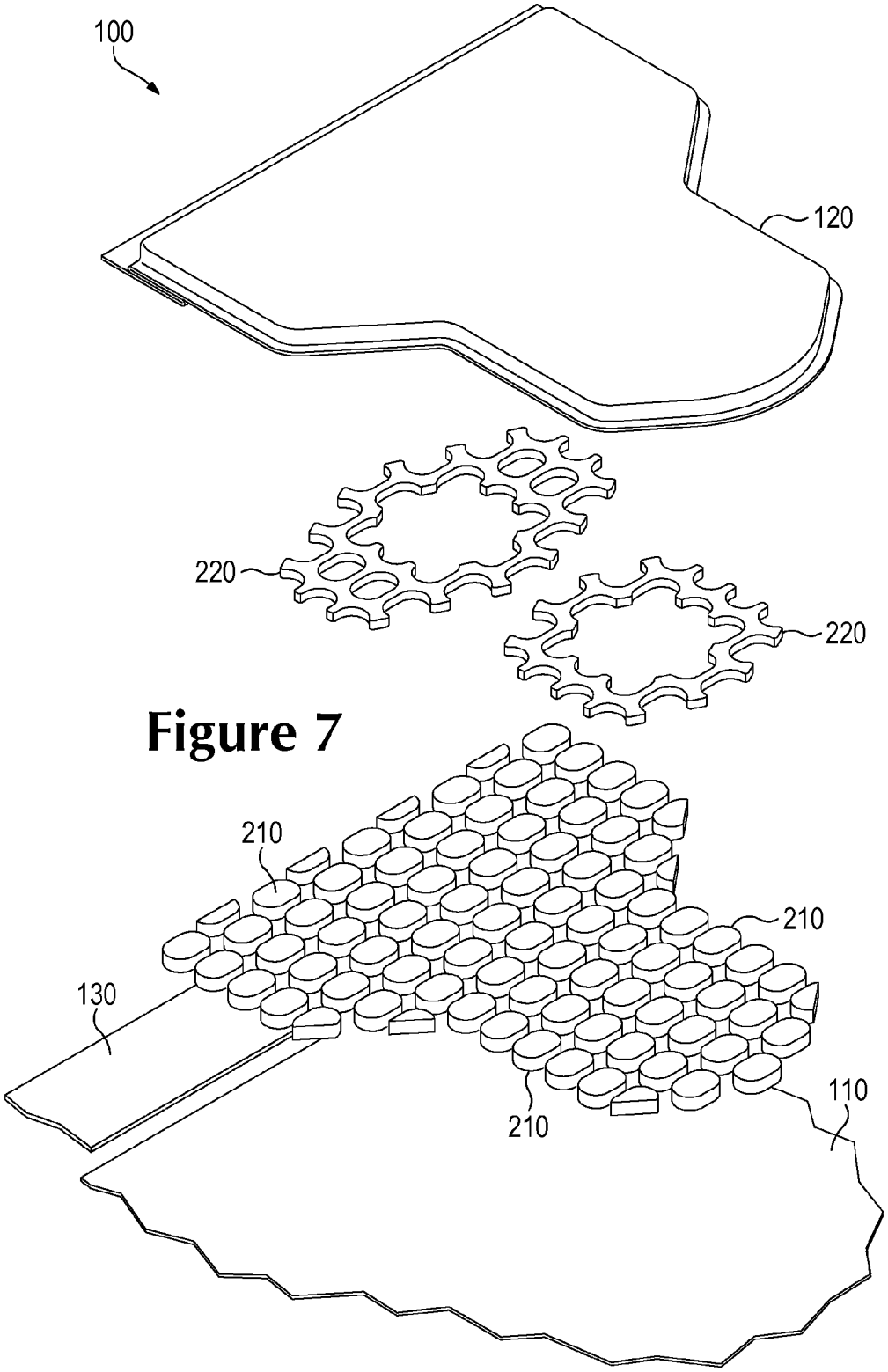
FIG. 7 is an exploded perspective view of the portion of the article of apparel.
Figure 8:
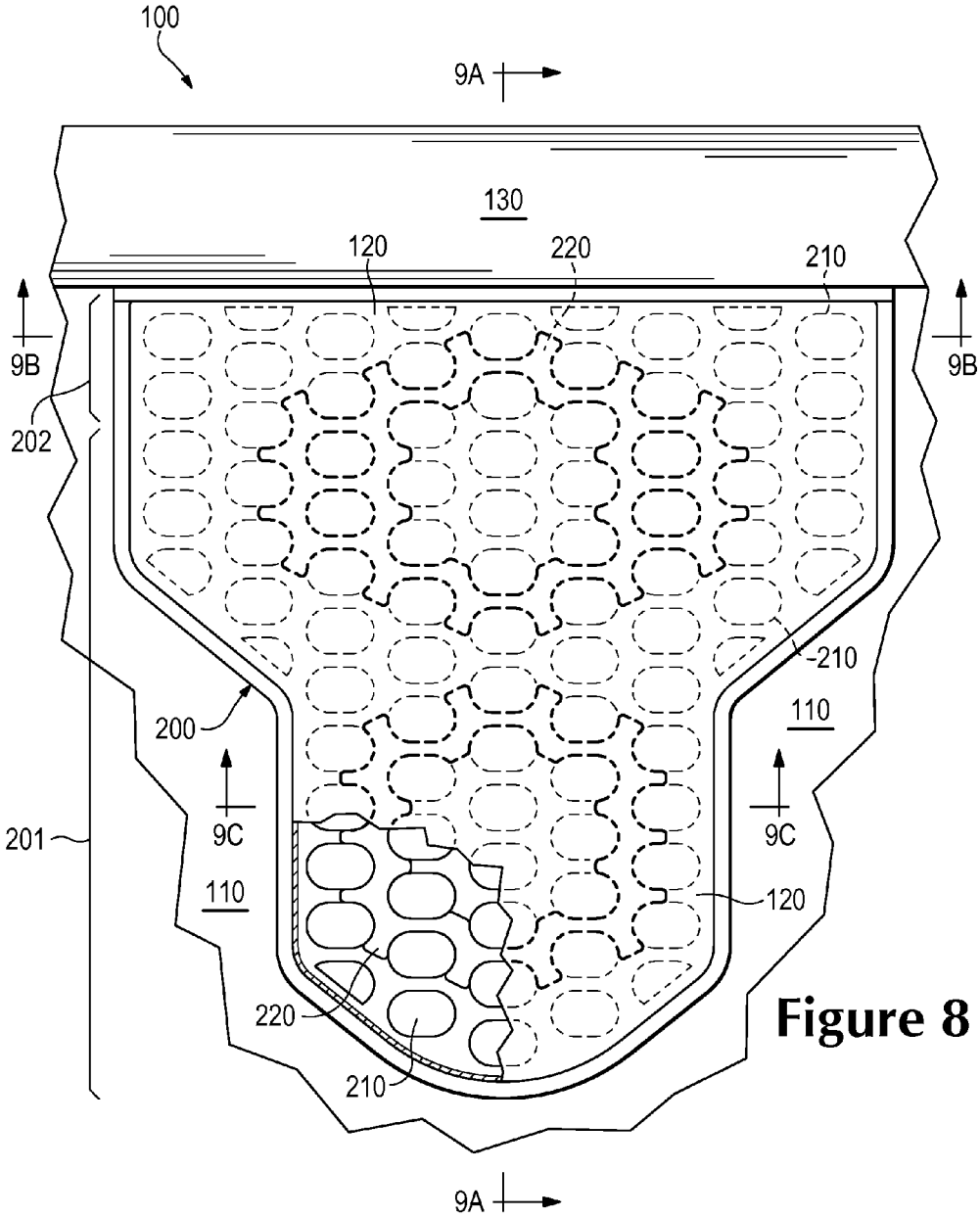
FIG. 8 is a top plan view of the portion of the article of apparel.

With reference to FIG. 1, an individual 10 is depicted as wearing an article of apparel 100 with the general configuration of a pants-type garment, specifically a pair of shorts. In further configurations, concepts associated with apparel 100 may be incorporated into apparel having the configuration of a pair of pants, a shirt-type garment (e.g., long-sleeved shirt, short-sleeved shirt, jacket, coat, undershirt), headwear (e.g., hat, headband), a brace or covering (e.g., for a shoulder, elbow, knee, or ankle), or glove, for example. Although apparel 100 may be worn under other articles of apparel, apparel 100 may be worn alone, may be exposed, or may be worn over other articles of apparel. Apparel 100 may also be worn in combination with other pieces of equipment (e.g., athletic or protective equipment). Accordingly, the configuration of apparel 100 and the manner in which apparel 100 is worn by individual 10 may vary significantly.

Apparel 100 is depicted individually in FIGS. 2-5 as including a pelvic region 101 and a pair of leg regions 102 that extend outward from pelvic region 101. Pelvic region 101 corresponds with a pelvic area of individual 10 and covers at least a portion of the pelvic area when worn. An upper area of pelvic region 101 defines a waist opening 103 that extends around a waist of individual 10 when apparel 100 is worn. Leg regions 102 correspond with a right leg and a left leg of individual 10 and cover at least a portion of the right leg and the left leg when worn. Lower areas of leg regions 102 each define a thigh opening 104 that extends around a thigh of individual 10 when apparel 100 is worn. Additionally, apparel 100 includes an exterior surface 105 that faces away from individual 10 when apparel 100 is worn, and apparel 100 includes an opposite interior surface 106 that faces toward individual 10 and may contact individual 10 when apparel 100 is worn.

Each of pelvic region 101 and leg regions 102 include a variety of textile elements (e.g., a base element 110, a cover element 120, a waistband 130, as discussed below) that effectively form a garment portion of apparel 100. That is, the textile elements are joined (e.g., at seams through stitching, adhesive bonding, or thermal bonding) to impart the configuration of the shorts-type garment to apparel 100. The textile elements also form areas for receiving various protective elements 200, which are incorporated into various areas of apparel 100 to impart padding, cushioning, or otherwise attenuate impact forces. When apparel 100 is worn during athletic activities, for example, protective elements 200 may protect individual 10 from contact with other athletes, equipment, or the ground. With regard to apparel 100, protective elements 200 are located in both of pelvic region 101 and leg regions 102 and are positioned, more specifically, to protect the hips, thighs, and tailbone of individual 10.

Protective Element Configuration

A portion of apparel 100 that includes one of protective elements 200 is depicted in FIGS. 6-9C. In general, protective element 200 includes a plurality of pad components 210 and two frame components 220 that are located between base element 110 and cover element 120. Although pad components 210 are secured to base element 110 and cover element 120, frame component 220 is unsecured to each of base element 110, cover element 120, and pad components 210. Base element 110 forms a majority of interior surface 106 and is located to contact individual 10 when apparel 100 is worn, with waistband 130 forming a smaller portion of interior surface 106. Cover element 120 extends over pad components 210 and is joined to base element 110 around the periphery of pad components 210. A combination of base element 110, cover element 120, and waistband 130 forms, therefore, a majority of exterior surface 105.

Base element 110 and cover element 120 cooperatively form an outer surface or covering for protective element 200. That is, base element 110 and cover element 120 cooperatively form a pocket or void, in which pad components 210 and frame component 220 are located. Whereas base element 110 is depicted as having a generally planar configuration, cover element 120 extends over pad components 210 and frame components 220 and also along sides of pad components 210 to join with base element 110 (e.g., through stitching, an adhesive, or thermal bonding). Although protective element 200 may be incorporated into apparel 100 in a variety of ways, cover element 120 may be positioned exterior of base element 110. An advantage to this configuration is that protective element 200 protrudes outward from apparel 100, rather than protruding inward and toward individual 10. In some configurations of apparel 100, however, protective element 200 may protrude inward.

Textile elements may be utilized for base element 110 and cover element 120 in many configurations of apparel 100. As examples, base element 110 and cover element 120 may be formed from knitted, woven, or non-woven textile elements that include rayon, nylon, polyester, polyacrylic, cotton, wool, or silk. Moreover, the textiles may be non-stretch, may exhibit one-directional stretch, or may exhibit multi-directional stretch, and the textiles may have a continuous configuration or may be mesh materials that define apertures. A variety of other materials may also be utilized for base element 110 and cover element 120, including various polymer sheets, leather, and synthetic leather, for example. Combinations of these materials (e.g., a polymer sheet bonded to a textile) may also be utilized for base element 110 and cover element 120. Although base element 110 and cover element 120 may be formed from the same material, each of base element 110 and cover element 120 may also be formed from different materials. Accordingly, a variety of materials are suitable for base element 110 and cover element 120.

Each of pad components 210 includes a first surface 211, an opposite second surface 212, and a side surface 213 that extends between surfaces 211 and 212. As discussed in greater detail below, protective element 200 includes an attached region 201 and a separated region 202, as identified in each of FIGS. 6, 8, and 9A. In attached region 201, pad components 210 are located between and secured to each of base element 110 and cover element 120. That is, first surface 211 is secured to cover element 120 and second surface 212 is secured to base element 110. In separated region 202, however, pad components 210 are located between a folded or overlapping portion of cover element 120 and secured to only cover element 120. That is, first surface 211 and second surface 212 are both secured to cover element 120. As discussed in greater detail below, the folded or overlapping portion of cover element 120 in separated region 202 forms a gap, separation, or pleat structure that permits protective element 200 to move independent of other portions of apparel 100 at the hip joint, thereby enhancing a range of movement of individual 10 and the overall comfort of apparel 100.

Although the shapes of pad components 210 may vary significantly, each of surfaces 211 and 212 are depicted as having an elliptical or generally elongate shape with rounded end areas, and side surface 213 extends in a generally straight fashion between surfaces 211 and 212. Pad components 210 are spaced evenly from each other and arranged in offset rows. Given the shape of protective element 200, various pad components 210 adjacent to the periphery of protective element 200 exhibit a truncated or partial configuration. Although pad components 210 exhibit a common or equal thickness, various pad components 210 may have different thicknesses. For example, the pad components 210 located at the periphery may have lesser thickness than pad components 210 located in central areas. In general, the thickness of pad components 210 may range from 3 to 30 millimeters or more. As a related matter, pad components 210 are depicted as being a plurality of separate elements for purposes of example, but may be interconnected, may be a single element, or may have a variety of other conventional or non-conventional configurations.

A variety of materials may be utilized for pad components 210, including various polymer foam materials that return to an original shape after being compressed. Examples of suitable polymer foam materials for pad components 210 include polyurethane, ethylvinylacetate, polyester, polypropylene, and polyethylene foams. Moreover, both thermoplastic and thermoset polymer foam materials may be utilized. In some configurations of protective element 200, pad components 210 may be formed from a polymer foam material with a varying density, or solid polymer or rubber materials may be utilized. Also, different pad components 210 may be formed from different materials, or may be formed from similar materials with different densities. The polymer foam materials forming pad components 210 attenuate impact forces to provide cushioning or protection. By selecting thicknesses, materials, and densities for each of the various pad components 210, the degree of impact force attenuation may be varied throughout protective element 200 to impart a desired degree of cushioning or protection.

Within protective element 200, frame components 220 are located between each of base element 110 and cover element 120. In contrast with pad components 210, frame components 220 are unsecured to each of base element 110 and cover element 120, and frame components 220 are also unsecured to pad components 210. This configuration permits frame components 220 to float or otherwise move relative to base element 110, cover element 120, and pad components 210. Frame components 220 each have a first surface 221, an opposite second surface 222, and a side surface 223 extending between surfaces 221 and 222. Additionally, frame components 220 define a plurality of apertures 224 having the general shape of pad components 210. Given this configuration, frame components 220 extend around and between various pad components 210. In areas where frame components 220 are present, the combination of pad components 210 and frame components 220 effectively form a foam layer within protective element 200. Although the dimensions of apertures 224 may substantially match the dimensions of pad components 210, frame components 220 may also be formed such that a gap extends between edges of apertures 224 and side surfaces 213 of pad components 230. In some configurations, frame components 220 may be absent from protective element 200.

Frame components 220 are located in two areas (e.g., an upper area and a lower area) of protective element 200. As an alternative, one or both frame components 220 may extend (a) throughout protective element 200 and define apertures 224 that extend around all of pad components 210, (b) around only centrally-located pad components 210, or (c) around only peripherally-located pad components 210. Referring to the cross-sectional views of FIGS. 9A-9C, for example, frame components 220 are depicted as exhibiting lesser thickness (i.e., distance between surfaces 221 and 222) than each of pad components 210. An advantage of this configuration is that frame components 220 may move relative to base element 110 and cover element 120, thereby enhancing the flexibility of protective element 200. As an example, frame components 220 may have a thickness of approximately 2 millimeters in a configuration wherein pad components 210 have a thickness of 7 millimeters. In other configurations, the thickness of frame components 220 may range from 1 to 20 millimeters or more. Although frame components 220 may exhibit lesser thickness than each of pad components 210, frame components 220 may also be thicker than some or all of pad components 210.

Any of the variety of materials discussed above as being suitable for pad components 210 may also be utilized for frame components 220, including various polymer foam materials that return to an original shape after being compressed. Examples of suitable polymer foam materials for frame component 220 include polyurethane, ethylvinylacetate, polyester, polypropylene, and polyethylene foams. Moreover, both thermoplastic and thermoset polymer foam materials may be utilized. In some configurations of protective element 200, frame components 220 may be formed from solid polymer or rubber materials.

The compressible polymer foam materials forming pad components 210 and frame components 220 attenuate impact forces that compress or otherwise contact protective element 200. When incorporated into apparel 100 or another article of apparel, for example, the polymer foam materials of pad components 210 and frame components 220 may compress to protect a wearer from contact with other athletes, equipment, or the ground. Accordingly, Protective element 200 may be utilized to provide cushioning or protection to areas of a wearer that are covered by protective element 200.

In addition to attenuating impact forces, protective element 200 has an advantage of simultaneously providing one or more of breathability, flexibility, a relatively low overall mass, and launderability. When incorporated into an article of apparel, particularly apparel used for athletic activities, a wearer may perspire and generate excess heat. By utilizing a permeable textile for base element 110 and cover layer 120 and also forming gaps between adjacent pad components 210 and areas between pad components 210 and frame components 220, areas for air to enter the apparel and for moisture to exit the apparel are formed through protective element 200. More particularly, air and moisture may pass through base element 110 and cover layer 120, between pad components 210 in areas where frame components 220 are absent, and between pad components 210 and frame components 220 in areas where frame components 220 are present to impart breathability to areas of the apparel having protective element 200. Moreover, the materials and structure discussed above for protective element 200 impart flexibility and a low overall mass. Furthermore, the materials and structure discussed above permits protective element 200 to be laundered without significant shrinkage or warping, even when temperatures associated with commercial laundering processes are utilized. Accordingly, protective element 200 may simultaneously provide impact force attenuation, breathability, flexibility, a relatively low overall mass, and launderability to an article of apparel, such as apparel 100.

Pleat Structure

Figure 9A:
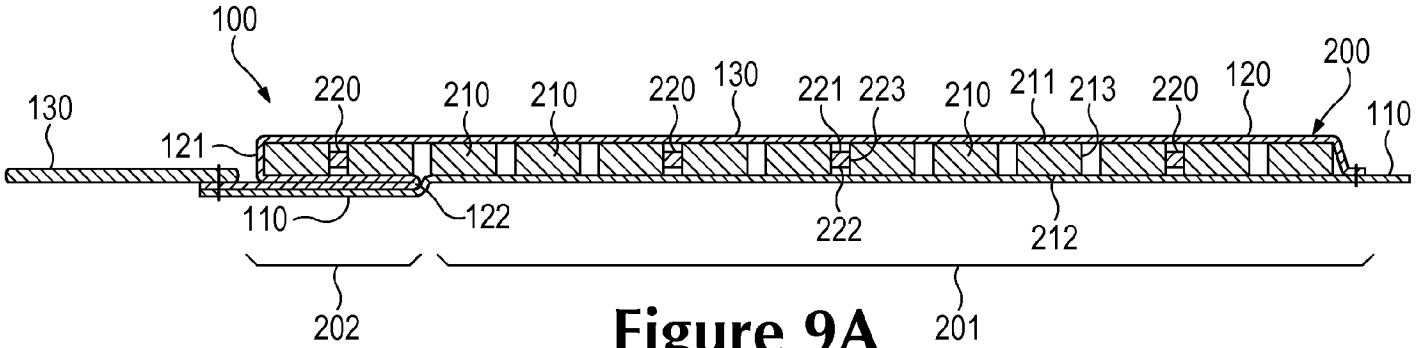
FIGS. 9A-9C are cross-sectional views of the portion of the article of apparel, as defined by section lines 9A-9C in FIG. 8.
Figure 9B:
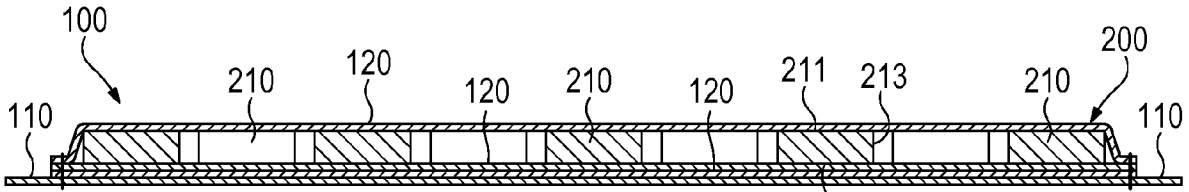
Figure 9C:
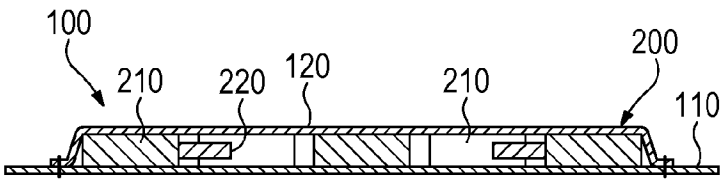

In separated region 202, apparel 100 has a configuration that permits protective element 200 to move independent of other portions of apparel 100 to enhance the range of movement of individual 10 and the overall comfort of apparel 100. Referring to FIG. 9A, cover element 120 includes a first fold 121 and a second fold 122 that effectively form an S-shaped configuration in separated region 202. Whereas first fold 121 wraps around various pad components 210 (i.e., from first surface 211 to second surface 212), second fold 122 forms an overlapping area in cover element 120 and extends along base element 110 to join with waistband 130. Although pad components 210 are present within first fold 121, pad components are absent from an area within second fold 122. Cover element 120 is secured to each first surface 211 of the various pad components 210. Due to first fold 121, cover element 120 is also secured to second surface 212 in at least separated region 202. In attached region 201, however, base element 110 is secured to second surface 212 of the various pad components 210.

An upper edge of protective element 200 is located adjacent to waistband 130, which is formed of a stretchable material and extends around individual 10. Often, waistband 130 extends above the hip joint of individual 10, which places a portion of protective element 200 over the hip joint. More particularly, the portion of protective element 200 in separated region 202 is located over the hip joint, whereas the portion of protective element 200 in attached region 201 protects the hip and areas of the leg around the hip. A portion of cover element 120 is secured to waistband 130 and extends away from waistband 130. Although areas of cover element 120 are secured to surfaces 211 and 212 of pad components 210, the portion secured to waistband 130 and extending away from waistband 120 is unsecured to pad components 200.

Figure 10A:
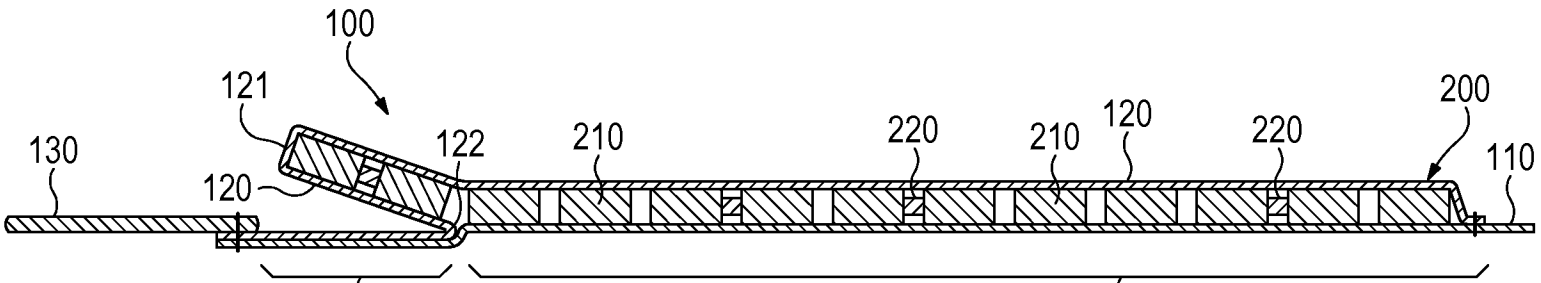
FIGS. 10A and 10B are cross-sectional views corresponding with FIG. 9A.
Figure 10B:
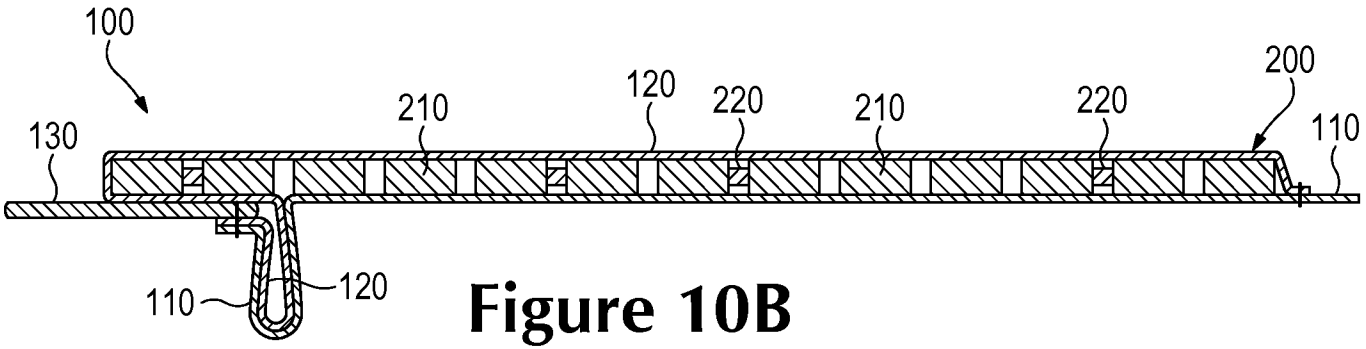

The overall configuration discussed above forms pleat structure in apparel 100 that allows portions of protective element 200 to move independently. More particularly, the overall configuration of cover element 120 (i.e., through folds 121 and 122 and the configuration of cover element 120 discussed above) allows protective element 200 to move or flex in separated region 202. As a first example, which is depicted in FIG. 10A, a portion of protective element 200 may flex to form a gap or separation between protective element 200 and other areas of apparel 100. That is, the pleat structure formed by cover element 120 allows the portion of protective element 200 in separated region 202 to flex, thereby forming the gap or separation. As a second example, which is depicted in FIG. 10B, the portion of protective element 200 in separated region 202 may move or slide over waistband 130 and areas of base element 110 and cover element 120. If, for example, protective element 200 is pushed by an upward force, then the pleat structure in apparel 100 would allow protective element 200 to slide over waistband 130, rather than bunching or compressing. Given that protective element 200 is located at a hip joint of individual 10, the flexing to form a gap or separation and the sliding permits protective element 200 to move independent of other portions of apparel 100, thereby enhancing a range of movement of individual 10 and the overall comfort of apparel 100.

Further Configurations

Aspects of apparel 100 may vary depending upon the intended use for apparel 100 and the product in which cushioning element 200 is incorporated. Moreover, changes to the dimensions, shapes, and materials utilized within protective element 200 may vary the overall properties of protective element 200. That is, by changing the dimensions, shapes, and materials utilized within protective element 200, the compressibility, impact force attenuation, breathability, flexibility, and overall mass of protective element 200 may be tailored to specific purposes or products.

Figure 11A:
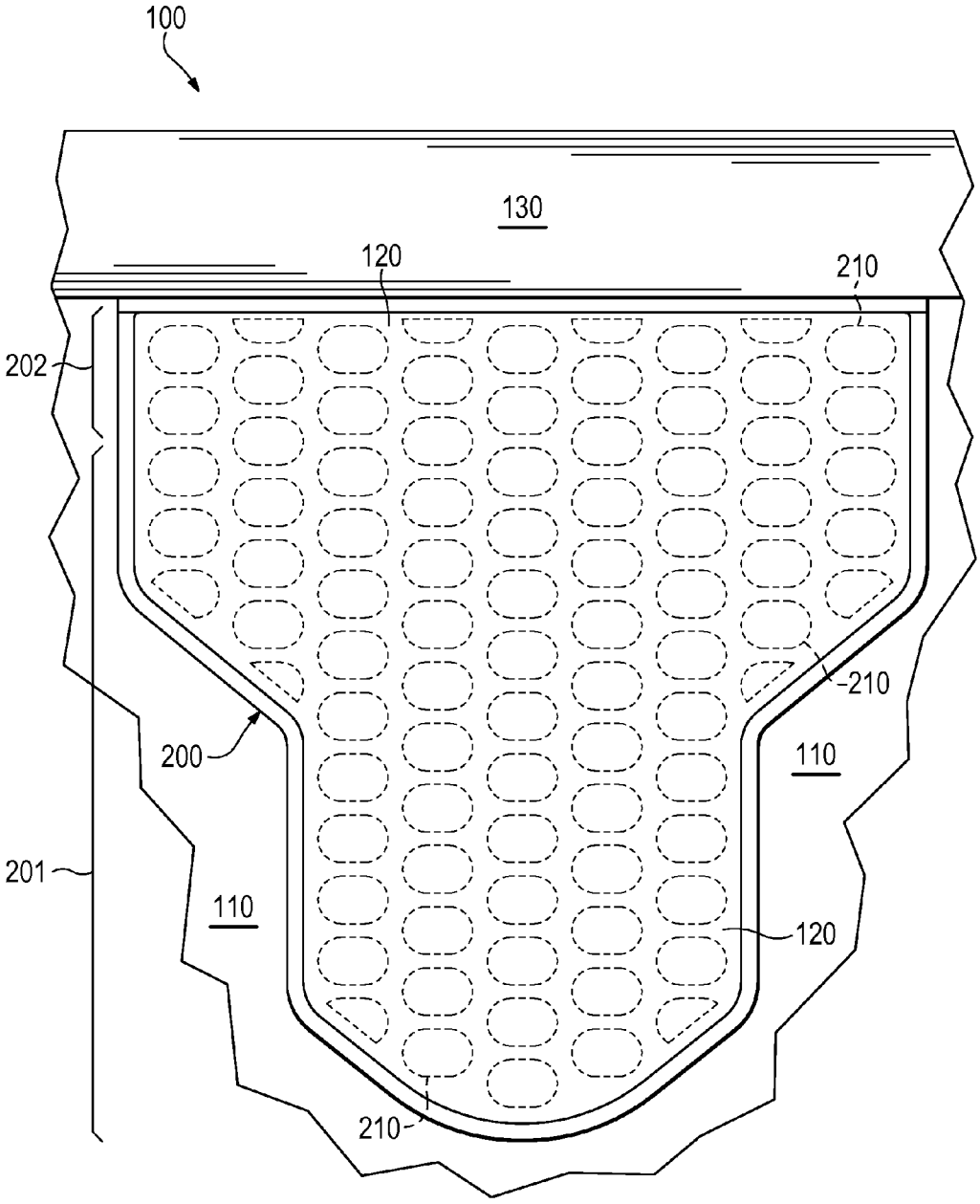
FIG. 11A-11F are top plan views corresponding with FIG. 8 and depicting further configurations of the article of apparel.
Figure 11B:
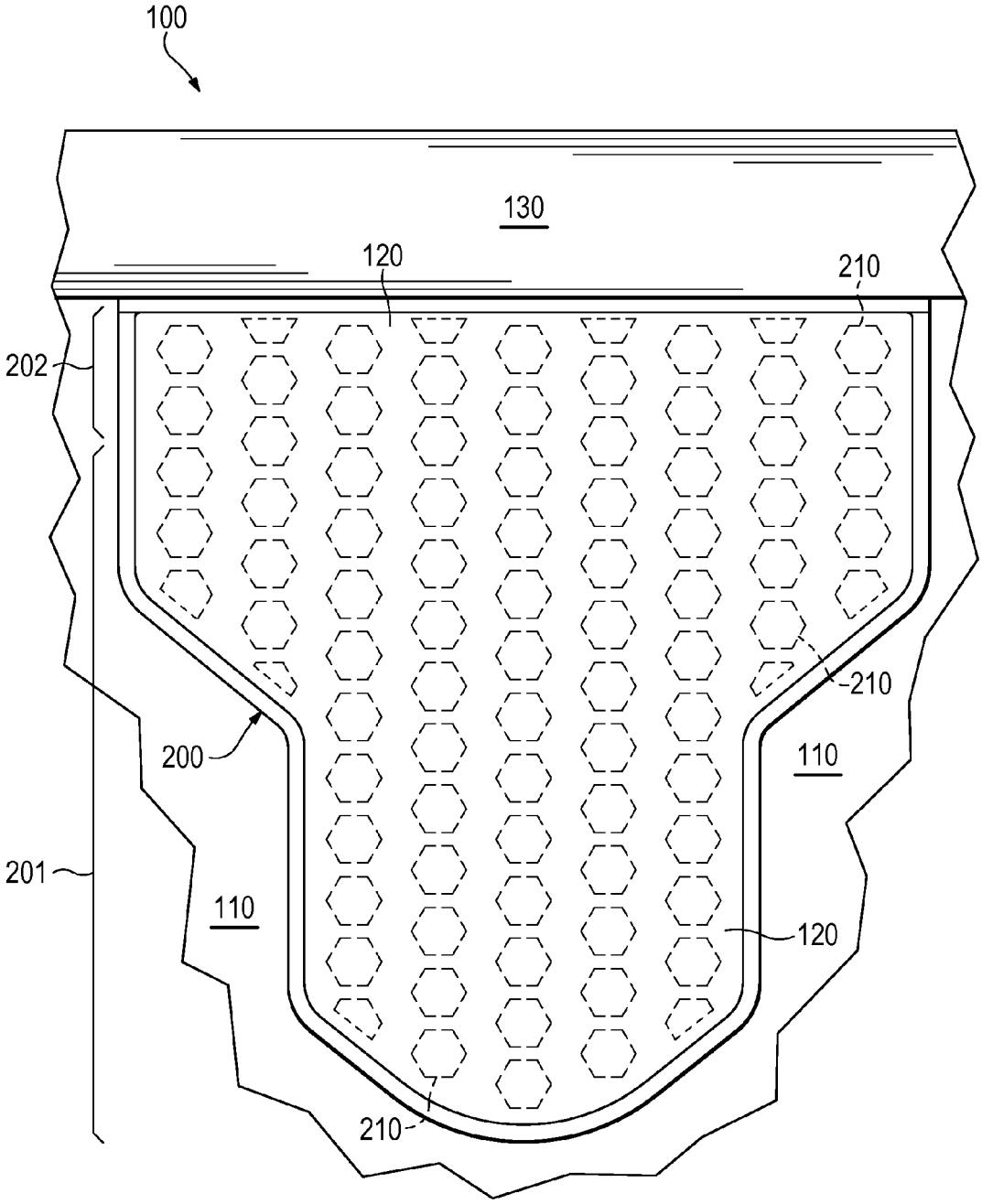
Figure 11C:
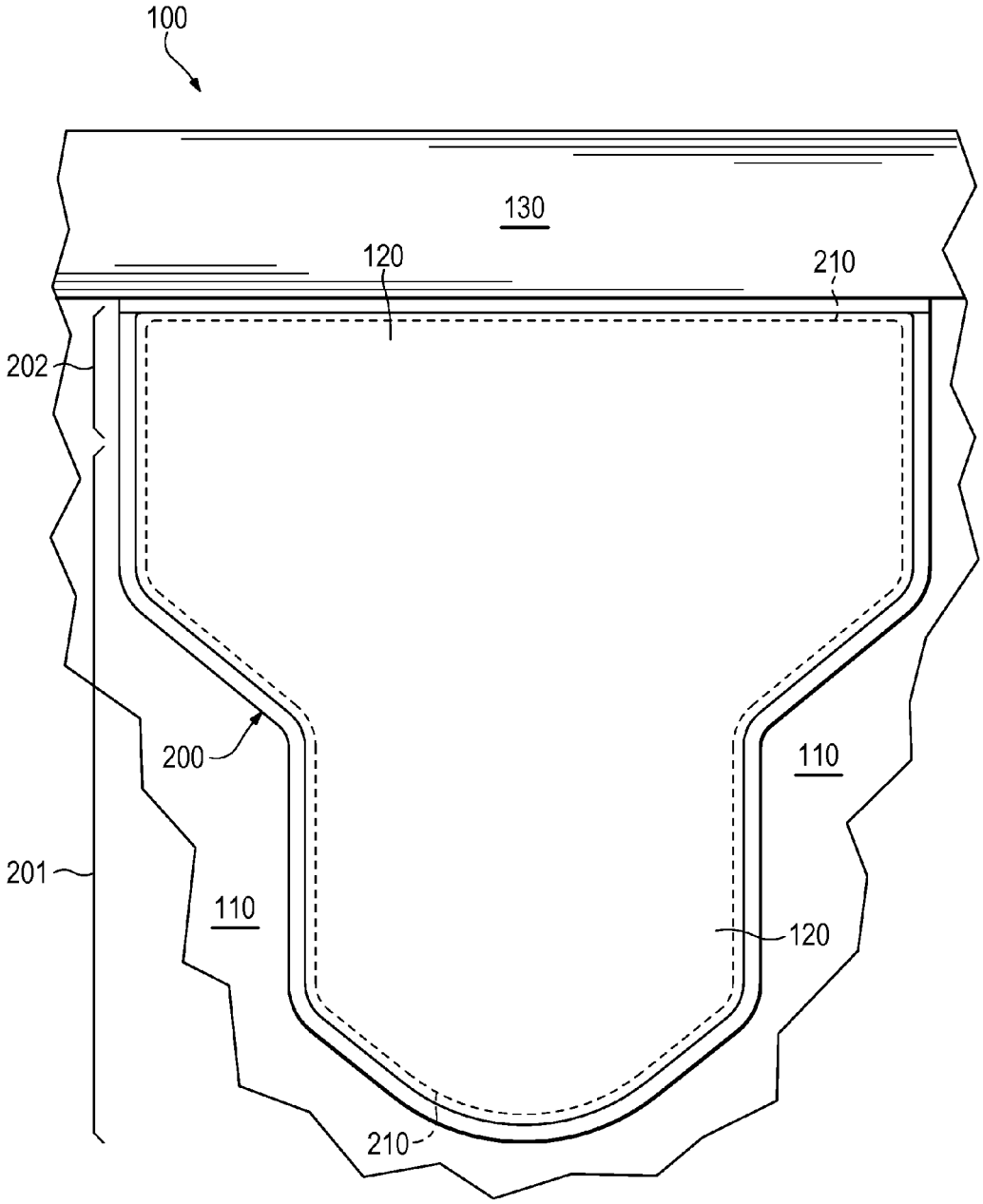
Figure 11D:
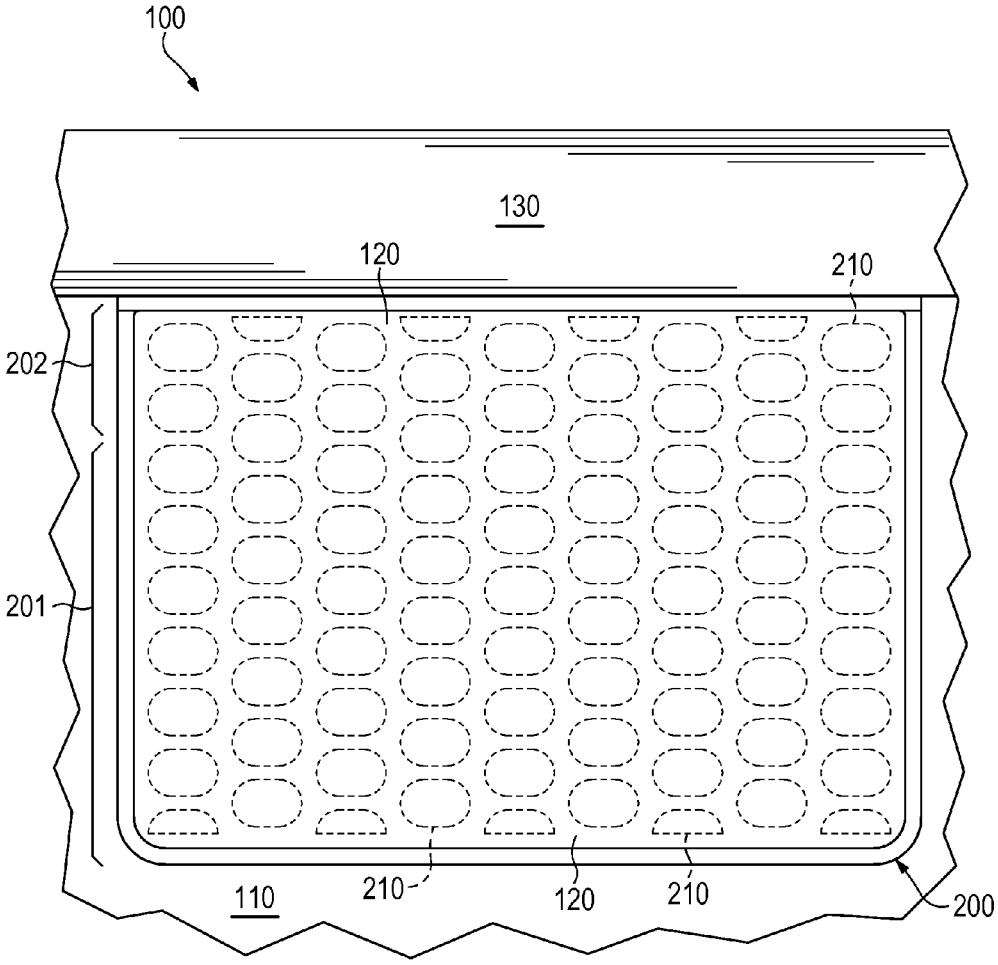
Figure 11E:
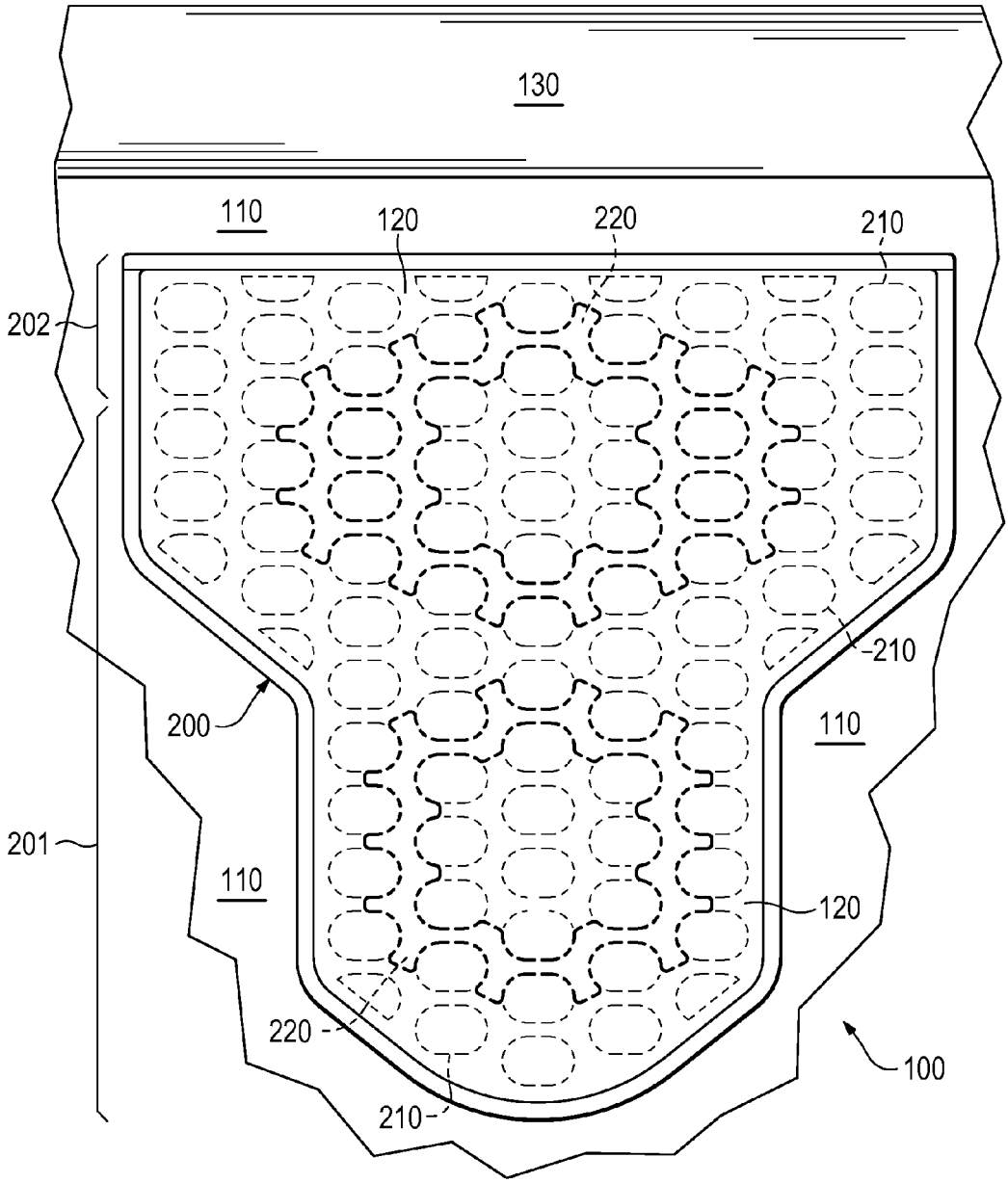
Figure 11F:
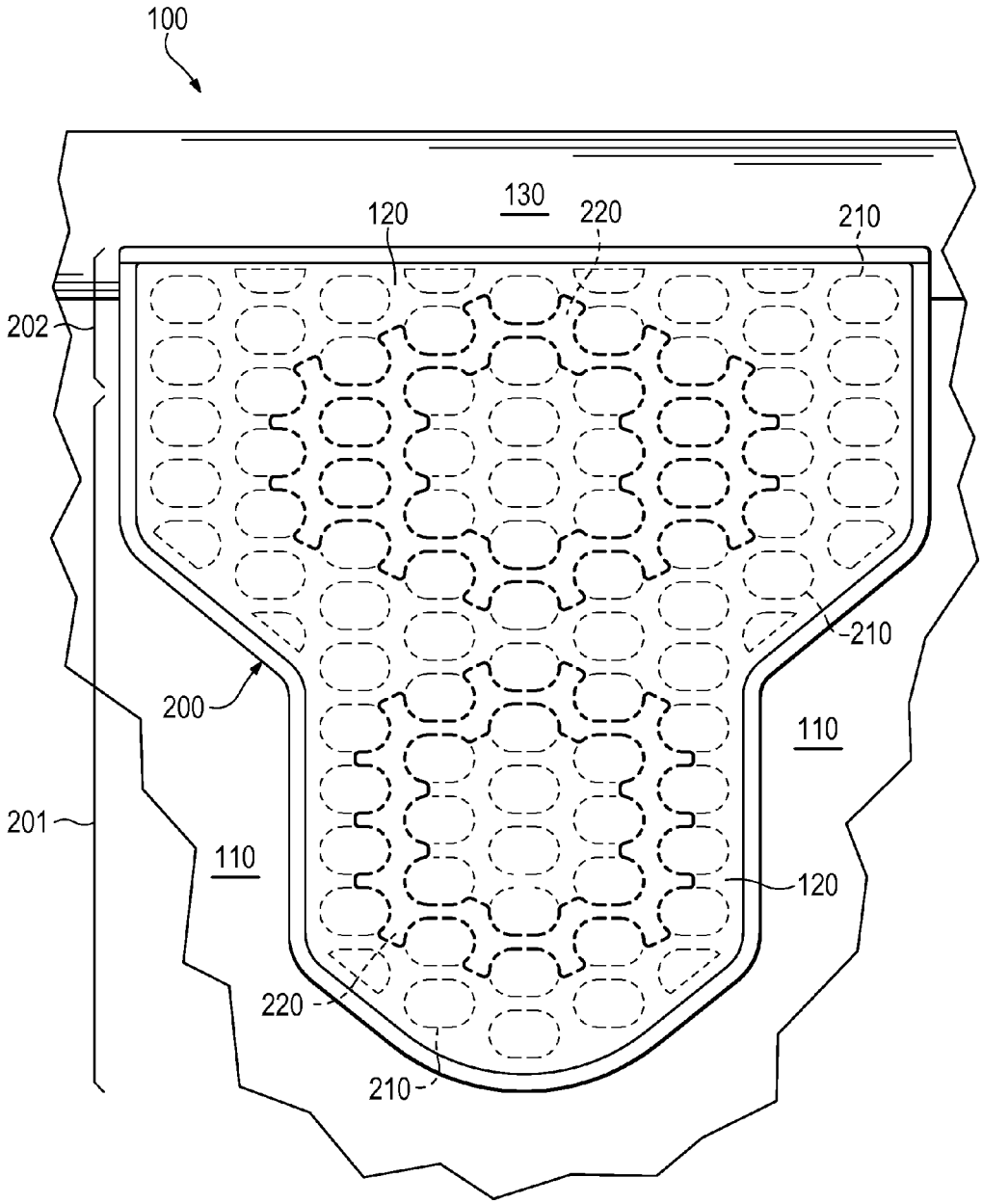

Further configurations of the portion of apparel 100 that includes protective element 200 are depicted in FIGS. 11A-11E. Referring to FIG. 11A, frame components 220 are absent from protective element 200. Aspects relating to pad components 210 may also vary. For example, the various pad components 210 have hexagonal shapes in FIG. 11B, but may also be circular, rectangular, elliptical or any other regular or irregular shape. In another configuration, as depicted in FIG. 11C, pad components 210 may be replaced by a single element of a foam material. The overall shape of protective element 200 may also vary significantly. Referring to FIG. 11D, protective element has a rectangular shape, but may also be circular, hexagonal, elliptical or any other regular or irregular shape. The location of protective element 200 may also vary. As depicted in FIGS. 11E and 11F, protective element 200 may be spaced from waistband 130 or may cover a portion of waistband 130.

Figure 12A:
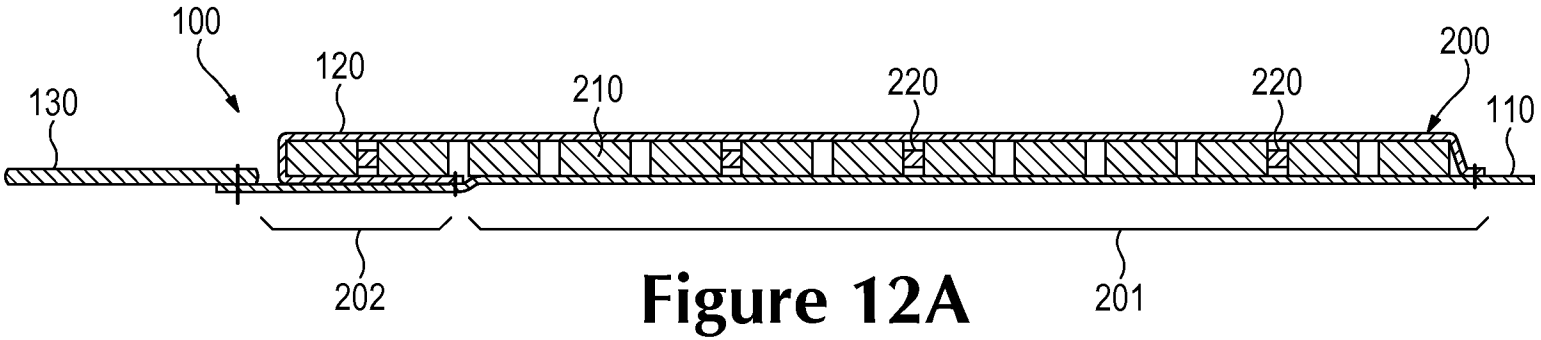
FIGS. 12A-12C are cross-sectional views corresponding with FIG. 9A and depicting further configurations of the article of apparel.
Figure 12B:
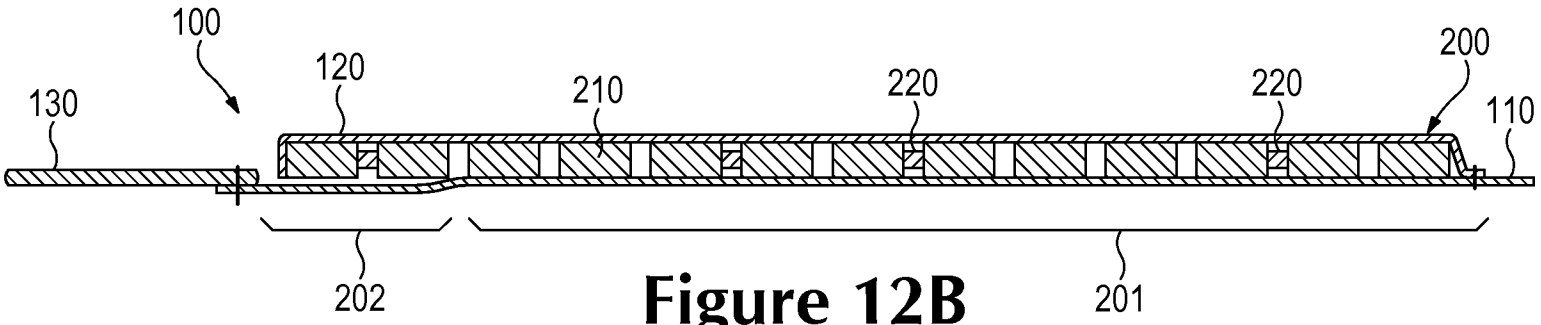
Figure 12C:
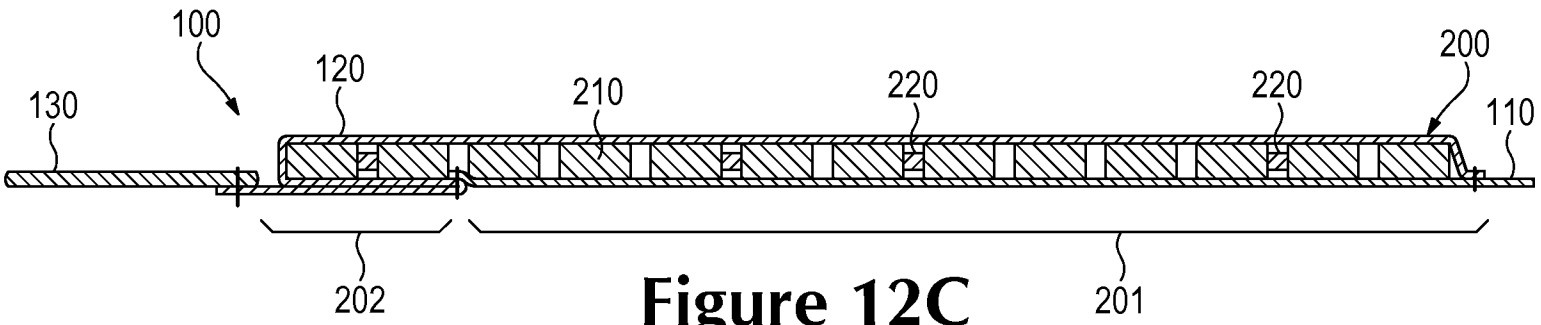

The manner in which the pleat structure is formed may also vary in apparel 100. Referring to FIG. 12A, for example, cover element 120 forms first fold 121, but an end of cover element 120 is secured to base element 110. In this configuration, therefore, second fold 122 is absent. As another example, FIG. 12B discloses a configuration wherein cover element 120 extends downward along side surface 223, but is absent from second surface 212, and base element 110 is unsecured to second surface 212 in separated region 202. As a further example, depicts a configuration wherein base element 110 terminates and is joined to cover element 120 as second fold 122. In each of these configurations, a gap, separation, or pleat structure is formed that permits protective element 200 to move independent of other portions of apparel 100, thereby enhancing a range of movement of individual 10 and the overall comfort of the apparel 100.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a garment portion formed from a plurality of joined textile elements, the garment portion having a first fold and a second fold that form a pleat structure, the first fold being located outward from the second fold and substantially overlapping the second fold; and at least one protective element at least partially located within the first fold and absent from an area within the second fold.

2. The article of apparel recited in claim 1, wherein the first fold and the second fold form an S-shaped region.

3. The article of apparel recited in claim 1, wherein one of the textile elements forms both the first fold and the second fold.

4. The article of apparel recited in claim 1, wherein the protective element includes a plurality of pad components formed from a polymer foam material.

5. The article of apparel recited in claim 1, wherein the article of apparel has a configuration for covering at least a joint area of a wearer, and the first fold and the second fold are located in an area that corresponds with the joint area.

6. The article of apparel recited in claim 1, wherein the protective element has a first surface and an opposite second surface, a first of the textile elements forms both the first fold and the second fold and is joined to both the first surface and the second surface, and a second of the textile elements is joined to only the second surface.

7. The article of apparel recited in claim 1, wherein the article of apparel is a shorts-type garment having a waistband, and the first fold and the second fold are located adjacent to the waistband.

8. An article of apparel comprising:

a garment portion formed from at least a first textile element and a second textile element, the first textile element forming a first fold and a second fold that form a pleat structure, the first fold being located outward from the second fold and substantially overlapping the second fold; and at least one protective element located within the first fold, the protective element having a first surface and an opposite second surface, the first surface being located outward from the second surface, the first textile element being joined to the first surface and the second surface, and the second textile element being joined to the second surface.

9. The article of apparel recited in claim 8, wherein the first fold and the second fold form an N-shaped configuration in the first textile element.

10. The article of apparel recited in claim 8, wherein the protective element includes a plurality of pad components formed from a polymer foam material.

11. The article of apparel recited in claim 8, wherein the article of apparel has a configuration for covering at least a joint area of a wearer, and the first fold and the second fold are located in an area that corresponds with the joint area.

12. The article of apparel recited in claim 8, wherein the article of apparel is a shorts-typed garment having a waistband, and the first fold and the second fold are located adjacent to the waistband.

13. An article of apparel comprising:

a plurality of pad components formed from a polymer foam material, at least a portion of the pad components having a first surface and an opposite second surface;

a first material layer secured to the first surface and forming an exterior surface of the article of apparel, the first material layer wrapping around to the second surface and being secured to a portion of the second surface in a separated region; and a second material layer secured to another portion of the second surface and forming an interior surface of the article of apparel, wherein the first material layer substantially overlaps the second material layer in the separated region.

14. The article of apparel recited in claim 13, wherein the first material layer forms a pleat structure having a first fold and a second fold, wherein the first fold substantially overlaps the second fold.

15. The article of apparel recited in claim 14, wherein the first fold and the second fold form an S-shaped configuration.

16. The article of apparel recited in claim 14, wherein the article of apparel has a configuration for covering at least a joint area of a wearer, and the first fold and the second fold are located in an area that corresponds with the joint area.

17. The article of apparel recited in claim 14, wherein the article of apparel is a shorts-type garment having a waistband, and the first fold and the second fold are located adjacent to the waistband.

18. An article of apparel comprising:

a band for extending around a portion of a wearer, the band being formed from a stretchable material;

at least one textile element joined to the band, a portion of the textile element extending away from the band; and a protective element formed from a compressible material, wherein a gap extends between the protective element and the portion of the textile element extending away from the band, wherein the gap is formed by substantially overlapping folds of the textile element.

19. The article of apparel recited in claim 18, wherein the textile element is joined to the protective element.

20. The article of apparel recited in claim 18, wherein the textile element is joined to a first surface and an opposite second surface of the protective element.

21. The article of apparel recited in claim 18, wherein the textile element has a first fold and a second fold that form a pleat structure, the first fold being located outward from the second fold, and the protective element is located within the first fold.

22. The article of apparel recited in claim 18, wherein the protective element includes a plurality of pad components formed from a polymer foam material.

23. An article of apparel having a configuration of a shorts-type garment, the apparel comprising:

a waistband for extending around a waist of a wearer, the waistband being formed from a stretch material;

at least one textile element extending away from the waistband; and a protective element located adjacent to the waistband and formed from a compressible material, wherein the textile element is folded and joined to opposite surfaces of the protective element, and the textile element defines a separated area between the protective element and the waistband, and wherein folds of the textile element substantially overlap proximate the separated area.

24. The article of apparel recited in claim 23, wherein the protective element includes a plurality of pad components formed from a polymer foam material.

25. An article of apparel comprising:

a garment portion formed from a plurality of joined textile elements that include a first textile element and a second textile element, at least the first textile element forming a portion of an interior surface of the article of apparel; and at least one protective element, a first area of the protective element being secured to the first textile element, and a second area of the protective element being unsecured to the first textile element to form a gap between the second area of the protective element and the first textile element; and wherein a first portion of the second textile element substantially overlaps a second portion of the second textile element proximate the second area of the protective element.

26. The article of apparel recited in claim 25, wherein the second textile element is secured to the second area of the protective element.

27. The article of apparel recited in claim 25, wherein the first textile element is joined to only a first surface of the protective element, and the second textile element is secured to both the first surface and an opposite second surface of the protective element.

28. The article of apparel recited in claim 25, wherein the protective element includes a plurality of pad components formed from a polymer foam material.

* * * * *